US008737570B2

(12) United States Patent
Firestone et al.

(10) Patent No.: US 8,737,570 B2
(45) Date of Patent: May 27, 2014

(54) GAMMA RAY GENERATOR

(75) Inventors: Richard B. Firestone, El Cerrito, CA (US); Jani Reijonen, Princeton, NJ (US)

(73) Assignee: The Regents of the University of California, Oakland, CA (US)

( * ) Notice: Subject to any disclaimer, the term of this patent is extended or adjusted under 35 U.S.C. 154(b) by 189 days.

(21) Appl. No.: 13/123,817

(22) PCT Filed: Oct. 7, 2009

(86) PCT No.: PCT/US2009/059843
§ 371 (c)(1),
(2), (4) Date: Jun. 20, 2011

(87) PCT Pub. No.: WO2010/051145
PCT Pub. Date: May 6, 2010

(65) Prior Publication Data
US 2011/0249801 A1 Oct. 13, 2011

Related U.S. Application Data

(60) Provisional application No. 61/109,426, filed on Oct. 29, 2008.

(51) Int. Cl.
*H05G 2/00* (2006.01)

(52) U.S. Cl.
USPC ..... 378/119

(58) Field of Classification Search
USPC ..... 378/119, 120, 124, 136, 139
See application file for complete search history.

(56) References Cited

U.S. PATENT DOCUMENTS 5,135,704 A * 8/1992 Shefer et al. ..... 376/108
7,430,479 B1 * 9/2008 Holslin et al. ..... 702/22
2006/0033022 A1 2/2006 Madigan

FOREIGN PATENT DOCUMENTS

WO WO 2008100269 A2 * 8/2008
WO WO 2008112034 A2 * 9/2008

OTHER PUBLICATIONS

International Search Report and Written Opinion for International Application No. PCT/US2009/059843 mailed Nov. 25, 2009.
Reijonen et al., Compact Neutron Generator Development at LBNL, American Nuclear Society 2003 Annual Meeting, San Diego, CA (US) (published Dec. 31, 2003).
Krusche et al., Nuclear Physics A386 (1982) 245-268.
Molnar et al., Nuclear Instruments and Methods in Physics Research B 213 (2004) 32-35.

* cited by examiner

*Primary Examiner* — Irakli Kiknadze
(74) *Attorney, Agent, or Firm* — Lawrence Berkeley National Laboratory

(57) ABSTRACT

An embodiment of a gamma ray generator includes a neutron generator and a moderator. The moderator is coupled to the neutron generator. The moderator includes a neutron capture material. In operation, the neutron generator produces neutrons and the neutron capture material captures at least some of the neutrons to produces gamma rays. An application of the gamma ray generator is as a source of gamma rays for calibration of gamma ray detectors.

12 Claims, 4 Drawing Sheets

| Eγ(keV) | Iγ per 100 captures |
|---|---|
| 292.178(4) | 0.271(3) |
| 436.222(2) | 0.939(6) |
| 517.0734(2) | 23.02(15) |
| 632.438(2) | 0.338(5) |
| 786.3021(4) | 10.38(9) |
| 936.920(3) | 0.523(4) |
| 1131.250(4) | 1.901(10) |
| 1164.867(5) | 27.06(12) |
| 1327.404(4) | 1.220(7) |
| 1601.074(5) | 3.675(22) |
| 1951.142(5) | 19.21(12) |
| 1959.348(5) | 12.44(9) |
| 2034.634(16) | 0.725(14) |
| 2676.338(17) | 1.617(12) |
| 2845.503(12) | 1.061(8) |
| 2863.823(7) | 5.52(3) |
| 2975.23(3) | 1.143(13) |
| 3015.975(18) | 0.997(8) |
| 3061.869(17) | 3.422(22) |
| 3115.988(23) | 0.903(8) |

| Eγ(keV) | Iγ per 100 captures |
|---|---|
| 3428.863(21) | 0.824(8) |
| 3981.00(5) | 1.006(22) |
| 4082.68(3) | 0.798(15) |
| 4440.397(16) | 1.143(11) |
| 4979.771(10) | 3.74(3) |
| 5517.223(17) | 1.699(14) |
| 5715.253(10) | 5.52(5) |
| 5902.721(17) | 1.128(13) |
| 6110.853(9) | 20.02(18) |
| 6619.627(9) | 7.68(7) |
| 6627.832(9) | 4.45(5) |
| 6977.847(10) | 2.25(3) |
| 7413.979(9) | 9.99(14) |
| 7790.343(10) | 8.07(10) |
| 8578.588(10) | 2.68(4) |

FIG. 4

GAMMA RAY GENERATOR

STATEMENT OF GOVERNMENT SUPPORT

This invention was made with government support under Contract No. DE-AC02-05CH11231 awarded by the U.S. Department of Energy to the Regents of the University of California for the operation and management of the Lawrence Berkeley National Laboratory. The government has certain rights in this invention.

CROSS REFERENCE TO RELATED CASE

This application claims priority to PCT Application PCT/US2009/059843, filed Oct. 7, 2009, which PCT application in turn claimed priority to Provisional U.S. Patent Application Ser. No. 61/109,426 filed Oct. 29, 2008, and entitled Gamma Ray Generator, the text of which applications are incorporated by reference herein, as if fully set out in their entirety.

BACKGROUND OF THE INVENTION

The present invention relates to the field of sources of high energy photons and more particularly, to the field of sources of gamma rays.

Routine energy and efficiency calibration of high-resolution HPGe (high purity Ge) detectors and other gamma ray detectors is limited to gamma ray energies of less than 2.6 MeV using normally available radioactive materials as the source of the gamma rays. Secondary radioactive standards that can be produced with a cyclotron extend the range to 3.5 MeV ($^{56}$Co, $t_{1/2}$=77 days) or 4.8 MeV ($^{66}$Ga, $t_{1/2}$=9.5 hr). These higher energy calibration standards are not readily accessible to most users and all radioactive sources require continuous safe storage since they are controlled radioactive materials.

SUMMARY OF THE INVENTION

The present invention is a gamma ray generator. An embodiment of the gamma ray generator includes a neutron generator and a moderator. The moderator is coupled to the neutron generator. The moderator includes a neutron capture material. In operation, the neutron generator produces neutrons and the neutron capture material captures at least some of the neutrons to produce gamma rays.

An application of the gamma ray generator is as a source of gamma rays for calibration of gamma ray detectors.

BRIEF DESCRIPTION OF THE DRAWINGS

The present invention is described with respect to particular exemplary embodiments thereof and reference is accordingly made to the drawings in which:

FIG. 4 illustrates a table of gamma ray energies and corresponding intensities for gamma rays produced in the prompt neutron capture reaction of $^{35}Cl(n,\gamma)^{36}Cl$.

DETAILED DESCRIPTION OF THE INVENTION

Figure 1:
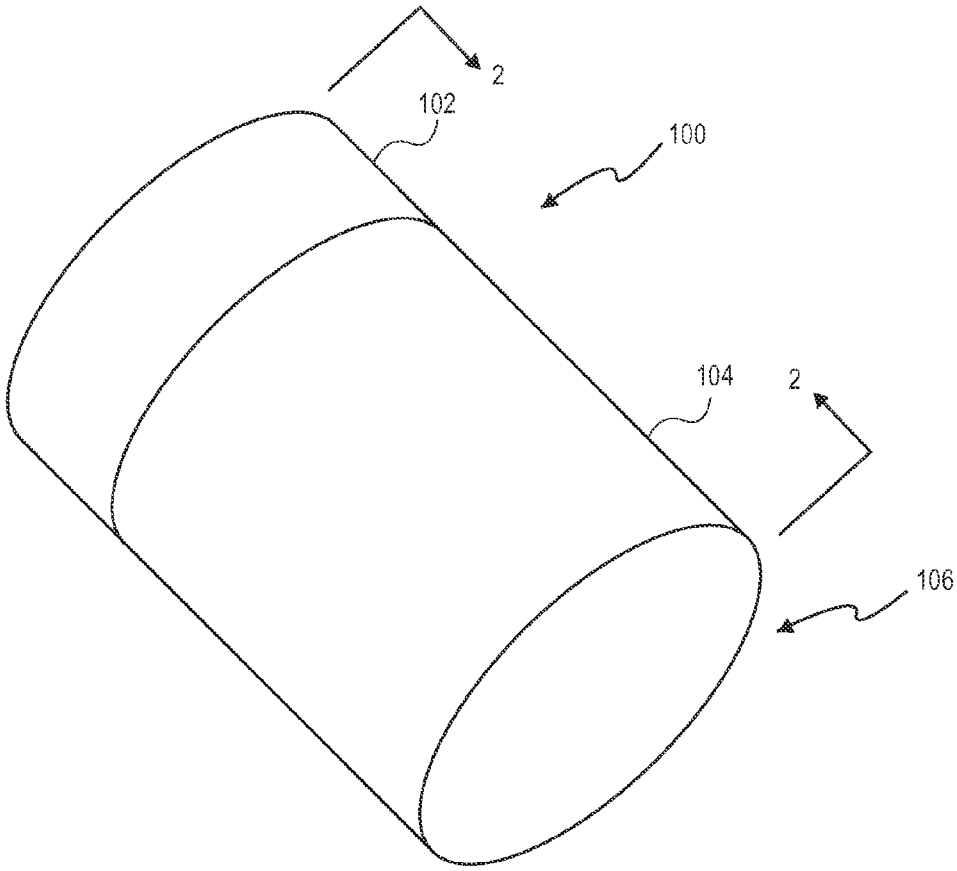
FIG. 1 illustrates an embodiment of a gamma ray generator of the present invention.

An embodiment of a gamma ray generator of the present invention is illustrated in FIG. 1. The gamma ray generator 100 includes a base 102, an outer shield 104, a neutron generator, and a moderator.

Figure 2:
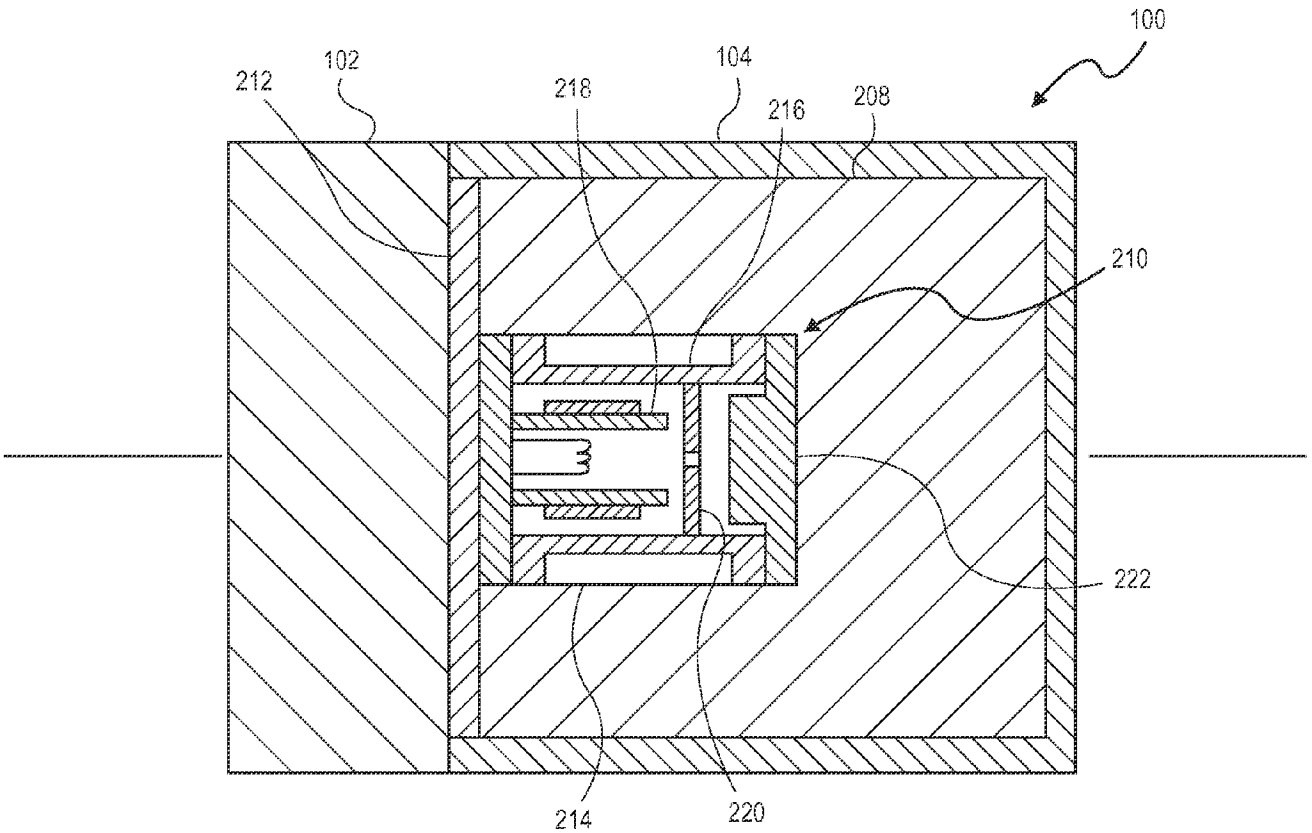
FIG. 2 illustrates a cross-section of a gamma ray generator of the present invention.

The gamma ray generator 100 is further illustrated in FIG. 2, which is a cross-sectional view of the gamma ray generator 100 and which depicts the base 102, the outer shield 104, the moderator 208, the neutron generator 210, and a shield plate 212. The neutron generator 210 is coupled to the base 102 by the shield plate 212. Alternatively, the shield plate 212 may be dispensed with altogether or it may be configured differently. For example, it may include a cut-out such that the neutron generator 210 couples to the base 102 not by way of the shield plate 212. The moderator 208 is coupled to the shield 104. The moderator 208 includes a cup-shaped cavity 214 into which the neutron generator 210 is inserted in order to assemble the gamma ray generator 100. The base 102 is made of aluminum or some other suitable material and is preferably grounded.

An embodiment of the neutron generator 210 includes a flanged tube 216, a plasma generator 218, a beam accelerator 220, and a target plate 222. The flanged tube 216 is made of a dielectric material such as alumina ($Al_2O_3$). The plasma generator 218 is inserted into the flanged tube 216 and a flanged end of the plasma generator 218 is brazed to a flange of the tube 216. The beam accelerator 220 is coupled to an inside of the tube 216 near the plasma generator 218. Preferably, the beam accelerator 220 is a single gap beam accelerator. The target plate 222 is brazed to the other flange of the tube 216. Brazing of the plasma generator 218 and the target plate 222 to the flanged tube 216 forms a vacuum tube that houses the plasma generator 218, the beam accelerator 220, and the target plate 222.

Figure 3:
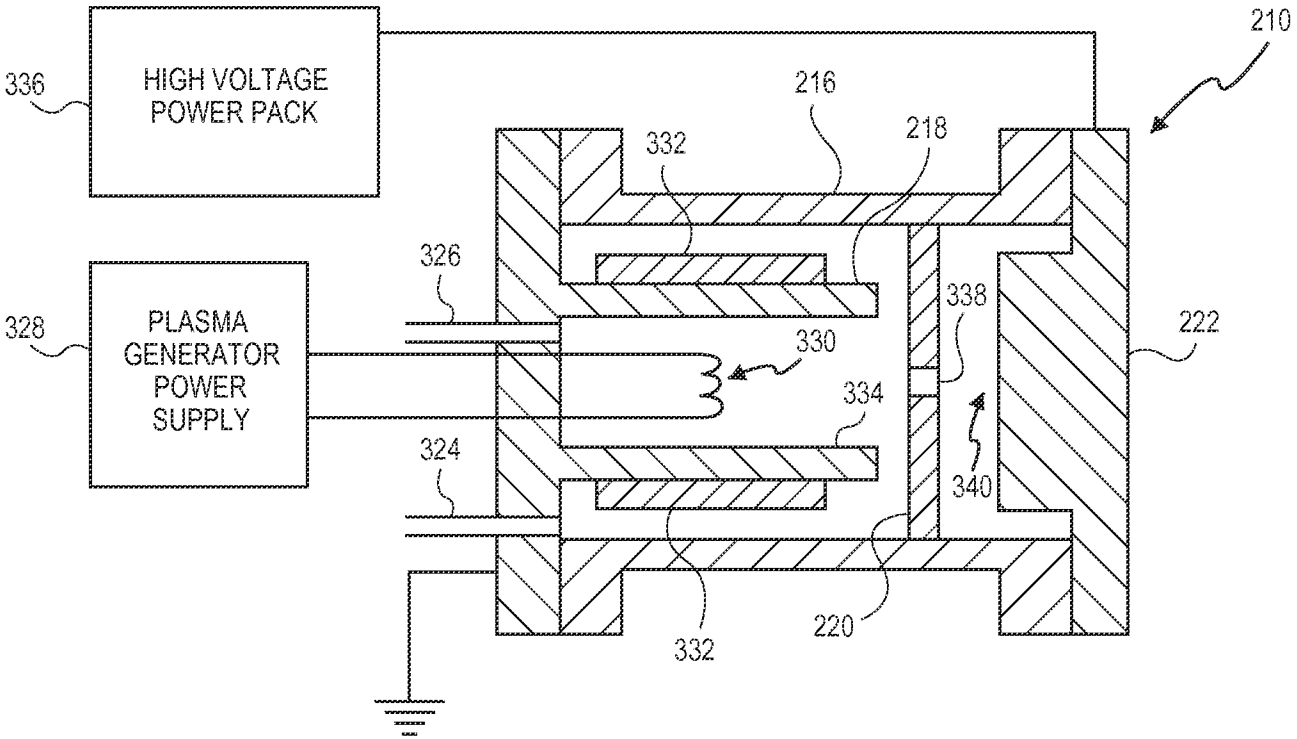
FIG. 3 illustrates a neutron generator of the present invention.

The neutron generator 210 is further illustrated in FIG. 3. The plasma generator 218 and the beam accelerator 220 of the neutron generator 210 form an ion source. A vacuum line 324 maintains an interior of the neutron generator 210 at a low ambient pressure. A gas line 326 feeds D (deuterium) into the plasma generator 218. A power supply 328 provides power to a cathode 330 (i.e. a hot cathode), which generates a plasma that includes D ions within the plasma generator 218. Magnets 332 tend to keep discharge electrons from moving directly to a wall 334 of the plasma generator 218. In an alternative embodiment, the cathode 330 is replaced with electrodes that form an arc or spark when powered by the power supply 328 where the arc or spark generates the plasma. The target plate 222 is preferably biased at approximately −40 kV by a power pack 336, which causes an ion beam to be extracted through a gap 338 of the beam accelerator 220. Alternatively, the target plate 222 is biased within a range of approximately −30 to −60 kV. The power supply 328 and the power pack 336 may be powered by a 12 V DC power supply, which for example may be a battery or 110 V AC to 12 V DC converter.

The ion beam impinges a target 340 of the target plate 222 that initially causes D ions to load the target 340. The target 340 may be a Ti target or some other suitable H absorbing target such as Sc or Zr. As the ion beam continues to impinge the target 340, the target 340 develops a neutron generating capability. Neutrons are generated in D-D reactions resulting from incoming D ions fusing with previously implanted target D atoms. The neutrons exit the target 340 in all directions. Preferably, the neutron generator produces approximately $10^5$ to $10^6$ n/s.

An alternative embodiment of the gamma ray generator 100 replaces the neutron generator 210 with a different neutron generator such as a neutron generator that includes an ion source that produces a plasma through RF induction discharge or microwave radiation. Neutron generators are well known in the art.

In an alternative embodiment of the neutron generator 210, the vacuum line 324 and the gas line 326 are combined into a single line where initially the single line is used to apply vacuum to the neutron generator and then to feed a sufficient amount of D to operate the neutron generator. In yet another embodiment of the neutron generator 210, the single line is sealed upon applying the vacuum and feeding the sufficient amount of D either by filling the volume with the sufficient amount of D gas or by utilizing a gas storage unit (i.e., a getter) that releases the gas when heated or pumping the gas when cooled.

In alternative operating modes of the neutron generator 210, the gas line 326 feeds T (tritium) or a combination of D and T into the plasma generator 218 in which case the neutron generator 210 produces neutrons in T-T reactions or a combination of D-D, D-T, and T-T reactions, respectively. These alternative operating modes are less preferred because T is radioactive requiring additional requirements for safe handling such as sealing the neutron generator and safe storage when not in use.

The neutron generator 210 is expected to have a D-D neutron yield on the order of $10^5$ n/s when 100 μA of beam is accelerated to 40 kV using a 10% duty cycle. This means that total beam power with these parameters is anticipated to be 400 mW and this beam power could be sufficiently low that active cooling (e.g. water cooling) is not employed. Alternatively, active cooling may be included.

Referring to FIG. 2, the moderator 208 includes a neutron capture material. Preferably, the moderator 208 is a hydrogenous moderator (i.e., the moderator includes H). In an embodiment, the moderator is made of PVC $(C_2H_3Cl)_n$ where the neutron capture material is Cl and the high $^{35}Cl$ cross section (43.5 barns) captures most of the neutrons. In other embodiments, the moderator includes a material selected from any element or compound including, for example, polyethylene $(CH_2)_n$ for production of 2.2 MeV gamma rays, Ti for production of gamma rays up to 10.6 MeV, Eu for production of a white source of gamma rays from 0-6.3 MeV, or Au for production of a short-lived 411.8044 keV gamma ray which is the NIST standard gamma-ray energy. Non-hydrogenous moderators would be embedded in a hydrogenous moderator to facilitate the thermalization of neutrons and maximize production of the gamma rays of interest.

The neutrons produced by the neutron generator 210 are thermalized by collisions with H in the moderator and captured by the neutron capture material, which produces gamma rays in all directions by prompt neutron capture. These gamma rays have a known energy spectrum and intensities in accordance with a particular choice of the neutron capture material. For example, neutrons that bombard a PVC moderator in which Cl is the neutron capture material produce gamma rays in the reaction $^{35}Cl(n,\gamma)^{36}Cl$ that have an energy spectrum and intensities as reported by R.B. Firestone et al. in, "Database of Prompt Gamma Rays from Slow Neutron Capture for Elemental Analysis," IAEA STI/PUB/1263 (2007), (which is a general reference that covers data for all moderators), in Table 7.3 at pp 91-92, where intensities $I_\gamma$ per 100 neutron captures are provided by $100\cdot\sigma_\gamma^Z(E_\gamma)/\sigma_\gamma^Z$ in which $\sigma_\gamma^Z(E_\gamma)$ is the partial elemental capture cross-section and $\sigma_\gamma^Z$ is the elemental capture cross-section.

A compilation of particular energies $E_\gamma$ in keV from the energy spectrum for $^{35}Cl(n,\gamma)^{36}Cl$ and corresponding intensities $I_\gamma$ per 100 neutron captures is provided as a table in FIG. 4. It is noted that the number in parentheses is FIG. 4 are standard deviation errors in the last digits of the corresponding numbers.

It will be readily apparent to one skilled in the art that the moderator may be made from a wide selection of materials that provide a wide range of neutron capture materials. Depending upon the choice of neutron capture material, moderators can be produced which generate gamma rays having energies within the range of approximately 0 to 11 MeV.

Referring to FIG. 2, the outer shield 104 and the shield plate 212 substantially surround the moderator in order to stop thermal neutrons that are not absorbed by the neutron capture material from escaping the gamma ray generator 100. Preferably, the outer shield 104 and the shield plate 212 are made of borated polyethylene which has a high thermal neutron cross section (3836 barns) and produces a low intensity 0.5 MeV gamma ray. Alternately, the outer shield 104 and shield plate 212 can be made of $^6Li$ impregnated polyethylene which produces virtually no gamma rays. $^6Li$ is a strategic material that is not readily available making it use more applicable to military or homeland security applications. A metal shield (not shown) may surround the outer shield 212 in order to absorb low energy gamma rays. The outer shield 102 and the shield plate 212 are not needed for operation of the gamma ray generator 100 and either or both may be dispensed with in some embodiments.

The neutron generator 210 and the gamma ray generator 100 as discussed herein are relatively safe in operation producing no more radiation than the sources it replaces and no radiation when not in use. For example, if the neutron generator 210 is operated to produce a neutron yield of $10^5$ n/s without the moderator 208 or the outer shield 104 installed, the non-moderated neutron flux at 10 cm from the target would be approximately 80 n/cm$^2$/s. This corresponds to a dose of 10 mrem/hr that is well within safe limits. Installing the moderator 208 would reduce this by an order of magnitude. The device only produces short lived radiation and requires no radiation concerns when stored (i.e., when the gamma ray generator 100 is not powered).

One application of the gamma ray generator 100 is as a calibration device for gamma ray detectors. For example, the gamma ray generator 100 can be used to calibrate a high-resolution HPGe (high purity Ge) detector by placing such a detector near an end 106 (FIG. 1) of the gamma ray generator 100 in which the neutron capture material is Cl, activating the gamma ray generator 100, measuring a response of the detector, and calibrating the response to the energy spectrum of the neutron capture material. In another example, the gamma ray generator 100 can be used to calibrate large detectors that are intended for homeland security screening of cargo. This latter example may use a moderator 208 made of polyethylene $(CH_2)_n$ where the neutron capture material H produces a single 2.2 MeV gamma-ray suitable for calibrating low resolution scintillator detectors. Another application of the gamma ray generator 100 is as a calibration device for large scintillators such as neutrino detectors where a single energy sum peak at the neutron separation energy (8.6 MeV for $^{36}Cl$) is produced. Further, the neutron generator 210 of the gamma ray generator 100 may be used without the moderator 208 in university physics labs for a variety of physics demonstrations or for the practical education of nuclear engineers in subject of neutron reaction physics.

The foregoing detailed description of the present invention is provided for the purposes of illustration and is not intended to be exhaustive or to limit the invention to the embodiments disclosed. Accordingly, the scope of the present invention is defined by the appended claims.

What is claimed is:

1. A gamma ray generator comprising:

a neutron generator including:

a plasma generator;

an ion beam accelerator; and a target, the plasma generator being configured to generate a plasma, the ion beam accelerator being configured to accelerate a portion of the plasma to generate an ion beam, and the target being configured to have the ion beam impinge thereupon to generate neutrons;

a moderator comprising a neutron capture material, the moderator defining a cavity that houses an end of the neutron generator including the target, and the neutron capture material being configured to capture at least some of the neutrons to generate gamma rays; and a neutron shield substantially surrounding the moderator, the neutron shield being configured to stop neutrons that are not captured by the neutron capture material.

2. The gamma ray generator of claim 1, wherein the moderator surrounds at least a hemisphere of the target of the neutron generator.

3. The gamma ray generator of claim 1, wherein the moderator includes a material selected from the group consisting of poly(vinyl chloride), polyethylene, a first hydrogenous material that includes Ti, Eu, or Au, and a second hydrogenous material in which Ti, Eu, or Au are embedded.

4. The gamma ray generator of claim 1, wherein the ion beam accelerator is configured to accelerate the portion of the plasma due to a bias applied to the target.

5. The gamma ray generator of claim 4, wherein the bias applied to the target is within the range of about −30 kV to −60 kV.

6. The gamma ray generator of claim 4, wherein the bias applied to the target is approximately −40 kV.

7. The gamma ray generator of claim 1, wherein the plasma includes ions selected from the group consisting of deuterium, tritium, and a combination thereof.

8. The gamma ray generator of claim 1, wherein the plasma generator is selected from the group consisting of a hot cathode type plasma generator and a spark type plasma generator.

9. The gamma ray generator of claim 1, wherein the ion beam accelerator is a single gap accelerator.

10. The gamma ray generator of claim 1, wherein the target comprises Ti.

11. The gamma ray generator of claim 1, wherein the moderator is polyethylene and the neutron capture material is hydrogen.

12. The gamma ray generator of claim 1, wherein the moderator is poly(vinyl chloride) and the neutron capture material is chlorine.

* * * * *